US008851031B2

(12) United States Patent
Yan

(10) Patent No.: US 8,851,031 B2
(45) Date of Patent: Oct. 7, 2014

(54) PISTON-TRAIN GUIDE APPARATUS AND METHOD

(71) Applicant: Yan Engines, Inc., Austin, TX (US)

(72) Inventor: Miin Jeng Yan, Austin, TX (US)

(73) Assignee: Yan Engines, Inc., Austin, TX (US)

( * ) Notice: Subject to any disclaimer, the term of this patent is extended or adjusted under 35 U.S.C. 154(b) by 0 days.

(21) Appl. No.: 13/900,395

(22) Filed: May 22, 2013

(65) Prior Publication Data

US 2013/0312703 A1 Nov. 28, 2013

Related U.S. Application Data

(60) Provisional application No. 61/649,933, filed on May 22, 2012.

(51) Int. Cl.

| | |
|---|---|
| ***F02B 75/04*** | (2006.01) |
| ***F02B 75/32*** | (2006.01) |
| ***F02F 3/00*** | (2006.01) |
| ***F02B 41/04*** | (2006.01) |
| *F02B 75/02* | (2006.01) |

(52) U.S. Cl.

CPC . *F02F 3/00* (2013.01); *F02B 75/32* (2013.01); *F02B 2075/025* (2013.01); *F02B 41/04* (2013.01)

USPC ..... 123/48 B; 123/78 BA; 123/71 R; 123/197.3

(58) Field of Classification Search

USPC ..... 123/48 A, 48 AA, 48 B, 78 A, 78 B, 123/78 BA, 179.3, 179.4, 51 R, 71 R, 197.3, 123/197.4

See application file for complete search history.

(56) References Cited

U.S. PATENT DOCUMENTS

| | | | | |
|---|---|---|---|---|
| 857,410 A | | 6/1907 | Morey, Jr. | |
| 1,572,918 A | * | 2/1926 | Geddes | 74/45 |
| 1,852,890 A | | 4/1932 | MacFarlane | |

(Continued)

FOREIGN PATENT DOCUMENTS

WO 2011123571 A1 10/2011

OTHER PUBLICATIONS

International Search Report of corresponding counterpart international application No. PCT/US2013/042290 dated Oct. 8, 2013.

*Primary Examiner* — Hai Huynh

(74) *Attorney, Agent, or Firm* — Lloyd L. Davis; Andrews Kurth LLP

(57) ABSTRACT

A differential stroke reciprocating internal combustion engine having an engine shaft and a piston configured to reciprocate within a cylinder chamber includes an inner piston part, a piston stem coupled at a first end to said inner piston part, an outer piston part which serves as a carrier for said inner piston part and is connected to said engine shaft, wherein said inner piston part is configured to operate on a cycle different from that of said outer piston part, and a control and linkage assembly coupled to said engine at an anchor point, and said control and linkage assembly pivotally coupled at a second end of said piston stem defining a copy point, wherein said control and linkage assembly guides and defines the movement of said copy point to be substantially aligned with an axis of said cylinder chamber.

17 Claims, 2 Drawing Sheets

(56) References Cited

U.S. PATENT DOCUMENTS

| | | | | | |
|---|---|---|---|---|---|
| 4,917,066 | A * | 4/1990 | Freudenstein et al. | 123/48 B |
| 4,979,428 | A * | 12/1990 | Nelson | 92/140 |
| 5,243,938 | A | 9/1993 | Yan | |
| 7,578,266 | B2 * | 8/2009 | Venturi | 123/48 B |
| 7,681,538 | B2 * | 3/2010 | Hiyoshi et al. | 123/48 B |
| 7,827,943 | B2 * | 11/2010 | Cannata | 123/48 B |
| 8,166,930 | B2 * | 5/2012 | Cho et al. | 123/48 B |
| 8,671,895 | B2 * | 3/2014 | Inden | 123/48 B |

* cited by examiner

PISTON-TRAIN GUIDE APPARATUS AND METHOD

CROSS-REFERENCE TO RELATED APPLICATIONS

This application claims priority under 35 U.S.C. §119(e) from U.S. Provisional Patent Application No. 61/649,933 filed on May 22, 2012, the entirety of which is incorporated herein by reference.

FIELD

Embodiments disclosed herein relate to internal combustion engines, and in particular, piston internal combustion engines. More particularly, embodiments disclosed herein relate to a piston-train guide apparatus for differential stroke internal combustion engines.

BACKGROUND AND SUMMARY

A differential-stroke internal combustion engine is disclosed in U.S. Pat. No. 5,243,938, which is incorporated herein by reference in its entirety. In the differential-stroke engine, the piston completes four separate strokes—intake, compression, power, and exhaust—during one crankshaft revolution. An inner piston portion slides along a respective cylinder bore wall as guided at a chamber end by the piston crown. The inner piston portion is coupled to a piston stem sliding along a piston pin penetration, which makes a lengthwise linear motion along the cylinder axis as a piston lever swings to make the strokes of the inner piston portion. This induces undesirable stresses on the components and may cause premature wear and tear, for example on the piston ring lands, on the piston stem and on the cylinder wall. What is needed then is a differential-stroke internal combustion engine that combines the advantages of four strokes of the piston with the advantages of one revolution of the crankshaft per cycle without inducing premature wear and tear and undesirable stresses on piston train components.

In one aspect, embodiments disclosed herein relate to a differential stroke reciprocating internal combustion engine having an engine shaft and a piston configured to reciprocate within a cylinder chamber comprising an inner piston part, a piston stem coupled at a first end to said inner piston part, an outer piston part which serves as a carrier for said inner piston part and is connected to said engine shaft, wherein said inner piston part is configured to operate on a cycle different from that of said outer piston part, and a control and linkage assembly coupled to said engine at an anchor point, and said control and linkage assembly pivotally coupled at a second end of said piston stem defining a copy point, wherein said control and linkage assembly guides and defines the movement of said copy point to be substantially aligned with an axis of said cylinder chamber.

In other aspects, embodiments disclosed herein relate to a control and guide apparatus for use with a piston having a piston stem disposed within a cylinder of an internal combustion engine, said control and guide apparatus defining a four-bar-linkage comprising a piston lever-link-bar, a fulcrum-link bar, a force-link bar, and a rocker-link-bar, wherein said four-bar-linkage is defined and located by a first hinge junction of a first end of said fulcrum-link bar and a first end of said rocker-link bar, a second hinge junction of a second end of said fulcrum-link bar and said piston lever-link-bar, a third hinge junction of a second end of said rocker-link bar and a first end of said force-link bar, and a fourth hinge junction of a second end of said force-link bar and said piston lever-link-bar, wherein said piston lever-link-bar is pivotally coupled at one end to said piston stem to define a linear lengthwise motion for said piston stem along said cylinder axis.

In yet other aspects, embodiments disclosed herein relate to a method of using a piston-train control and guide apparatus for an internal combustion engine including an inner piston part having a piston stem and moving within a cylinder under the guidance of said piston stem, the method comprising providing a piston-train control and guide apparatus comprising a piston lever-link-bar hingedly coupled at a first location to an end of said piston stem defining a copy point and a linkage assembly coupled to said piston lever at a second location of said piston lever, and said linkage assembly further hingedly coupled to said engine at a location defining an anchor point, and actuating said linkage assembly and moving said copy point in a linear parallel motion within said cylinder substantially along a cylinder axis.

BRIEF DESCRIPTION OF THE DRAWINGS

The invention is illustrated in the accompanying drawings wherein.

DETAILED DESCRIPTION

Figure 1:
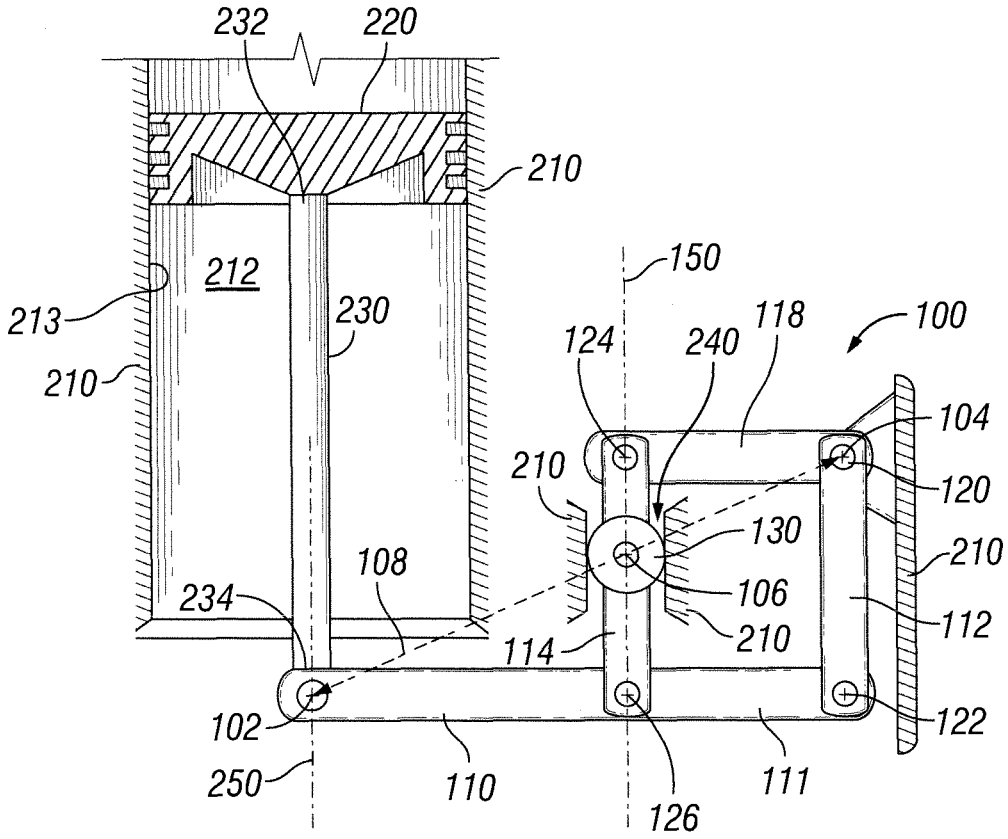
FIG. 1 illustrates a schematic view of a piston-train guide assembly in accordance with one or more embodiments of the present disclosure.

The aspects, features, and advantages of one or more embodiments mentioned herein are described in more detail by reference to the drawings, wherein like reference numerals represent like elements. Embodiments disclosed herein provide a piston-train guide apparatus (or assembly) incorporated within a piston-train in a differential stroke internal combustion engine Referring to FIG. 1, a schematic view of a piston-train guide assembly in accordance with one or more embodiments of the present disclosure is shown. The piston-train guide apparatus 100 (or assembly) may be incorporated within the piston-train in the differential stroke internal combustion engine illustrated in FIG. 2. As used herein, a "piston-train" may include a piston, piston lever-link-bar and guide assembly coupled together as an assembly and operable within the engine. The guide assembly may also be referred to herein as a control and guide apparatus or a control and linkage assembly.

The differential stroke internal combustion engine typically includes an engine block 210 having one or more cylinder bores 212, and an inner piston part 220 located within each of the one or more cylinder bores 212. The inner piston part 220 may be in sliding contact (or abutting) engagement with a respective cylinder bore wall 213. A piston stem 230 is coupled at a first end 232 to the inner piston part 220, and is hingedly (or pivotally) coupled at a second end 234 to a piston lever-link-bar 110. The hinged coupling (pivotal junction) may define a 'copy' point 102, described in greater detail below.

The guide apparatus 100 defines and includes a linkage assembly (e.g., a four-bar-linkage) including a portion 111 of the piston lever-link-bar 110, a fulcrum-link bar 112, a force-link bar 114, and a rocker-link bar 118. In defining and locating the four-bar-linkage, the guide apparatus 100 may be hingedly coupled to the engine block 210 at a first hinge junction 120 of a first end of the fulcrum-link bar 112 and a first end of the rocker-link bar 118. The hinged coupling (pivotal junction) defines an 'anchor' (or attachment) point 104, described in greater detail below. The four-bar-linkage further includes a second hinge junction 122 of a second end of the fulcrum-link bar 112 and a first end of the portion 111 of the piston lever-link-bar 110, a third hinge junction 124 of a second end of the rocker-link bar 118 and a first end of the force-link bar 114, and a fourth hinge junction 126 of a second end of the force-link bar 114 and a second end of the portion 111 of the piston lever-link-bar 110.

A guide element or guide roller 130 is coupled (for example rotatably or pivotally) to the force-link bar 114 at an 'origin' point (or axis) 106. The 'origin' point 106 is located at the intersection between the force-link bar 114 and an imaginary line—indicated by line 108—defined between the 'copy' point 102 and the 'anchor' point 104. The guide roller 130 may be in sliding or rolling contact with a guide apparatus 240. In certain embodiments, the guide apparatus 240 may be integrally formed as a structure within and defined by the engine block 210. For example, the guide apparatus may be formed as a channel, groove, or other structure within the engine. In other embodiments, the guide apparatus 240 may be rigidly attached or fastened to the engine block 210. As shown, in certain embodiments, the guide apparatus 240 may be linear or substantially linear. The guide roller 130 moves within the guide apparatus 240 such that the guide roller 130 and 'origin' point 106 move along a guide axis 150 of the guide apparatus 240 that is parallel to the cylinder axis 250 of cylinder 212. In certain embodiments, the guide element may include a spring element (not shown) of any type coupled to said linkage assembly to centrally bias and control said copy point substantially along said cylinder chamber axis.

The four-bar-linkage of the guide apparatus 100 may be configured to form a pantographic assembly or apparatus. It will be understood by those skilled in the art that a pantographic assembly may be formed from mechanical linkages connected in a manner based on parallelograms, such that movement of one point of the assembly (for example, the 'origin' point 106) produces respective (and possibly scaled) movements in a second point of the assembly (for example, the 'copy' point 102).

In certain embodiments, the scaled movement of the 'copy' point 102 is restrained along the cylinder axis 250 by the movement of the 'origin' point 106 along the guide axis 150. This pantographic assembly of the four-bar-linkage, which effectively translates motion in a controlled fashion, is used as a motion guide for the 'copy' point 102. Accordingly, in certain embodiments, the four-bar-linkage defines a pantographic device that guides the piston lever-link-bar 110 to move at the pivotal junction with the piston stem 230 (i.e., the 'copy' point 102) in a straight line motion lengthwise along the cylinder axis 250. In other words, as the origin point 106 travels along guide axis 150 of the linear guide 240, the copy point 102 travels in a lengthwise linear motion along cylinder axis 250 of the cylinder 212.

It will be appreciated that other guide elements or devices may also be incorporated with the four-bar-linkage of the guide apparatus 100 at locations that have a functional relationship with the linear motion of the copy point 102. As one example, a guide element or guide roller may be located on the piston lever-link-bar 110 at the junction 126 with the force-link bar 114. In this example, a curved or non-linear guide channel may guide lateral motion of the piston lever-link-bar 110, such that the pivotal junction 102 between the piston lever-link-bar 110 and the piston stem 230 makes linear lengthwise motions aligned with the cylinder axis 250 as the piston lever-link-bar 110 is oscillated to actuate and stroke the inner piston part 220.

In certain embodiments, a functional relationship exists between a particular location on the linkage assembly and the copy point 102. For example, the functional relationship may comprise moving a particular location on the linkage assembly, and consequently moving the copy point 102 accordingly. Further still, the functional relationship may comprise moving a particular location on the linkage assembly, in either a linear or non-linear fashion, and consequently moving the copy point 102 in a linear fashion. In certain embodiments, the particular location on the linkage assembly may comprise the origin point 106. Accordingly, the guide element or guide roller 130 may be incorporated with the four-bar-linkage at certain locations to provide linear motion to the copy point 102, as will be understood by those skilled in the art.

In certain embodiments, a spring device (not shown) located or attached at any location on the piston-train may be included. For example, the spring device may be proximal to the hinge junction 122 (of a second end of the fulcrum-link bar 112 and a first end of the portion 111 of the piston lever-link-bar 110) may restrict or guide lateral movement of the piston lever-link-bar 110. Lateral movement is defined as movement not substantially aligned with the cylinder axis 250. The spring may be any type of spring device as will be understood by one of ordinary skill in the art. Further, the spring may be anchored at one end to the engine block and the other end to the piston-train. Alternatively, the spring may be anchored to only the engine block. The spring may be biased to restrict or reduce lateral movement of the fulcrum-link bar 112 such that the piston stem 230 stays within a tolerance limit substantially aligned with the cylinder axis 250.

Figure 2:
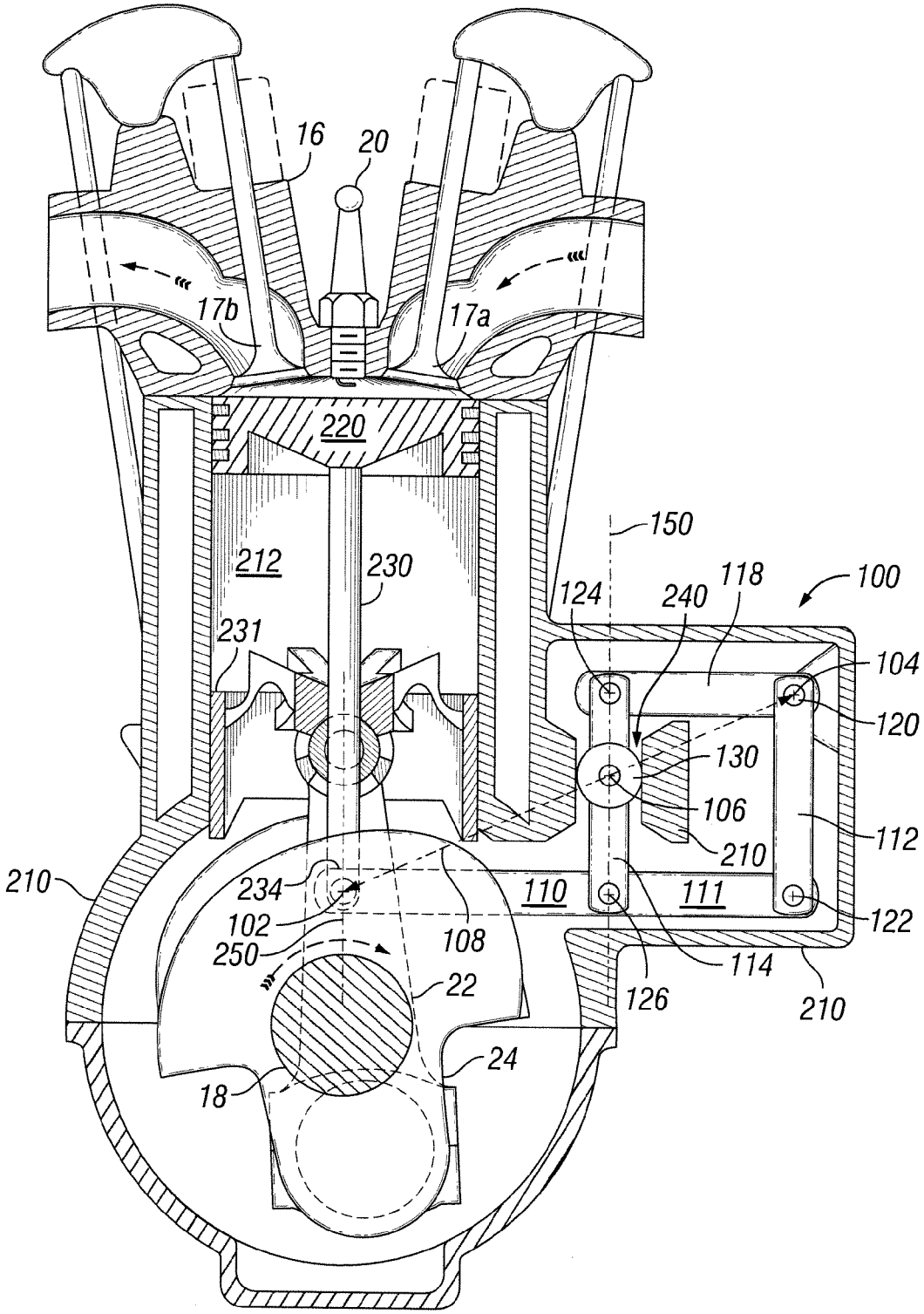
FIG. 2 illustrates a cross-section view normal to the axis of rotation of the crankshaft of a differential stroke engine having the piston-train guide assembly of FIG. 1 incorporated therewith.

Referring to FIG. 2, a cross-section view normal to the axis of rotation of the crankshaft of a differential stroke engine having a control and guide apparatus 100 incorporated therein in accordance with one or more embodiments of the present disclosure is shown. A differential stroke piston moves within the fixed cylinder 212 between a fixed cylinder head 16 above and a rotating crankshaft 18 below, referring to the orientation of the engine shown in FIG. 2. Charging and exhausting cylinder 212 is controlled by intake valve 17*a* and exhaust valve 17*b* respectively. Combustion is initiated by a spark plug 20 (not used in diesel applications) in cylinder head 16. Engine 210 is operable to complete one full combustion cycle per engine revolution.

The differential stroke piston has an inner piston part 220 which closes and seals the combustion chamber and an outer piston part 231 which is connected by a connecting rod 22 to the crankshaft 18 and also serves as a carrier for the inner piston part 220 during portions of its cycle. Embodiments disclosed herein provide for the inner piston part 220 to operate on four strokes per cycle and the outer piston part 231 to operate on two strokes per cycle. During the exhaust and the intake portions of the cycle, the inner piston part 220 and outer piston part 231 separate. During separation, inner piston part 220 is actuated and driven by the control and guide apparatus 100 described in FIG. 1. As shown, in certain embodiments, the guide apparatus 100 may be located outside of the cylinder and cylinder bore 212 and positioned away from the movements of the piston parts and engine shaft. Meanwhile, the outer piston part 231 continues to move under control of crank arm 24 and connecting rod 22.

Advantageously, embodiments disclosed herein provide a control and guide apparatus in which motion of the inner piston portion is guided at the chamber inner end by the piston crown sliding along the cylinder wall and at the piston stem outer end by the guide apparatus to move substantially along the cylinder axis. Because of the guide apparatus, and particularly the guide element movable within and along an axis of a guide channel, the inner piston part may move up and down with substantially no lateral movement of the piston stem and substantially little lateral thrust against the piston stem from the piston lever-link-bar. Accordingly, stresses and wear of the inner piston portion and on the cylinder wall induced by the piston sideways motions may be reduced. The guide apparatus may also reduce the sliding friction and 'slapping' of the inner piston portion against the cylinder wall.

Moreover, the four-bar-linkage assembly requires relatively little space (as shown in FIG. 2) within the engine itself. Still further, the four-bar-linkage, acting as a pantographic assembly, is capable of moving the piston stem and inner piston part an amount much larger than the amount required to move the guide element within the guide channel.

Reference throughout this specification to "one embodiment" or "an embodiment" or "certain embodiments" means that a particular feature, structure or characteristic described in connection with the embodiment is included in at least one embodiment of the present disclosure. Therefore, appearances of the phrases "in one embodiment" or "in an embodiment" or "in certain embodiments" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

In the claims below and the description herein, any one of the terms comprising, comprised of or which comprises is an open term that means including at least the elements/features that follow, but not excluding others. Therefore, the term comprising, when used in the claims, should not be interpreted as being limitative to the means or elements or steps listed thereafter. Any one of the terms including or which includes or that includes as used herein is also an open term that also means including at least the elements/features that follow the term, but not excluding others. Accordingly, including is synonymous with and means comprising.

It should be understood that the term "coupled," when used in the claims, should not be interpreted as being limitative to direct connections only. "Coupled" may mean that two or more elements are either in direct physical, or that two or more elements are not in direct contact with each other but yet still cooperate or interact with each other.

Although one or more embodiments of the present disclosure have been described in detail, it will be apparent to those skilled in the art that many embodiments taking a variety of specific forms and reflecting changes, substitutions and alterations may be made without departing from the spirit and scope of the invention. The described embodiments illustrate the scope of the claims but do not restrict the scope of the claims.

What is claimed:

1. A differential stroke reciprocating internal combustion engine having an engine shaft and a piston configured to reciprocate within a cylinder chamber comprising:

an inner piston part;

a piston stem coupled at a first end to said inner piston part;

an outer piston part which serves as a carrier for said inner piston part and is connected to said engine shaft, wherein said inner piston part is configured to operate on a cycle different from that of said outer piston part;

a control and linkage assembly coupled to said engine at an anchor point, said control and linkage assembly pivotally coupled at a second end of said piston stein defining a copy point, wherein said control and linkage assembly guides and defines the movement of said copy point to be substantially aligned with an axis of said cylinder chamber; and a guide element movable within a guide apparatus defined within said engine and coupled with said control and linkage assembly at a location defining an origin point, wherein said guide element guides said copy point to move linearly lengthwise along a cylinder axis.

2. The engine of claim 1, wherein said control and linkage assembly defines a four-bar-linkage including a piston lever-link-bar, a fulcrum-link bar, a force-link bar, and a rocker-link bar.

3. The engine of claim 2, wherein said four-bar-linkage is defined and located by:

a first hinge junction pivotally coupled to said engine and connecting a first end of said fulcrum-link bar and a first end of said rocker-link bar;

a second hinge junction connecting a second end of said fulcrum-link bar and a first end of said piston lever-link-bar;

a third hinge junction connecting a second end of said rocker-link bar and a first end of said force-link bar; and a fourth hinge junction connecting a second end of said force-link bar and a location on said piston lever-link-bar.

4. The engine of claim 1, wherein said guide element comprises a spring element to centrally bias said origin point within said guide apparatus and thereby control said copy point to move substantially along said cylinder chamber axis.

5. The engine of claim 2, wherein said four-bar linkage defines a parallelogram forming a pantograph, and wherein said origin point is located along a line defined between said copy point and said anchor point.

6. The engine of claim 5, wherein said guide element is configured to move within said guide apparatus linearly parallel to said cylinder chamber axis.

7. The engine of claim 1, further comprising a drive assembly configured to move said copy point in a first direction.

8. The engine of claim 7, wherein said drive assembly comprises a rocker drive assembly coupled to said control and linkage assembly and being operable by one or more cams coupled to said engine shaft.

9. A control and guide apparatus for use with a piston having a piston stem disposed within a cylinder of an internal combustion engine, said control and guide apparatus defining a four-bar-linkage comprising:

a piston lever-link-bar, a fulcrum-link bar, a force-link bar, and a rocker-link-bar, wherein said four-bar-linkage is defined and located by:

a first hinge junction of a first end of said fulcrum-link bar and a first end of said rocker-link bar, a second hinge junction of a second end of said fulcrum-link bar and first end of said piston lever-link-bar, a third hinge junction of a second end of said rocker-link bar and a first end of said force-link bar, and a fourth hinge junction of a second end of said force-link bar and a second location of said piston lever-link-bar, wherein said piston lever-link-bar is pivotally coupled at one end to said piston stem to define a linear lengthwise motion for said piston stem along said cylinder axis; and a guide element movable along a guide apparatus, wherein the motion of said guide element is related with motion of said pivotal coupling between said piston stem and said piston lever-link-bar.

10. The control and guide apparatus of claim 9, further comprising a pantograph apparatus defined by said four-bar-linkage, and further comprising a guide element coupled to said force-link bar at an origin point of said pantograph apparatus and in movable engagement with a guide apparatus defined within said engine.

11. The control and guide apparatus of claim 10, wherein said origin point is located at an intersection between said force-link bar and a line defined between said first hinge junction and said pivotal junction between said piston stem and said piston lever-link-bar.

12. The control and guide apparatus of claim 9, further comprising a drive assembly configured to move said pivotal coupling between said piston stem and said piston lever-link-bar in a first direction.

13. The control and guide apparatus of claim 12, wherein said drive assembly comprises a rocker drive assembly coupled to said four-bar-linkage and being operable by one or more cams coupled to said engine shaft.

14. A method of using a piston-train control and guide apparatus for an internal combustion engine, the method comprising:

providing a two-piece piston including an inner piston part having a piston stem and an outer piston part which serves as a carrier for said inner piston part, wherein said inner and outer piston parts are configured to operate on different cycles;

providing a piston-train control and guide apparatus comprising:

a piston lever-link-bar hingedly coupled at a first location to an end of said piston stem defining a copy point; and a linkage assembly coupled to said piston lever-link-bar at a second location of said piston lever-link-bar, and said linkage assembly further hingedly coupled to said engine at a location defining an anchor point;

providing a guide element movable within a guide apparatus defined within said engine and coupled with said linkage assembly at an origin point having a functional relationship with said copy point; and actuating said linkage assembly and moving said copy point in a linear parallel motion within said cylinder substantially along a cylinder axis.

15. The method of claim 14, further comprising:

moving said first location of said guide element along said guide apparatus; and accordingly, moving said inner piston part in a linear motion within said cylinder substantially along said cylinder axis.

16. The method of claim 14, further comprising:

defining a pantograph apparatus in said linkage assembly, wherein said pantograph apparatus defines a one-to-one scaled relationship between said origin point and said copy point;

moving said origin point a first linear distance, and moving said copy point a second linear distance, wherein said second linear distance is a scaled amount relative to said first linear distance.

17. The method of claim 14, further comprising providing a drive apparatus and moving said guide element within said guide apparatus to define said copy point in a linear motion along said cylinder axis.

* * * * *